US006351889B1

(12) United States Patent
Wall et al.

(10) Patent No.: US 6,351,889 B1
(45) Date of Patent: Mar. 5, 2002

(54) ADJUSTABLE-HEIGHT CAN OPENING APPLIANCE

(75) Inventors: Eric S. Wall, Clinton; Crystal R. Norris, Garden City, both of MO (US)

(73) Assignee: The Holmes Group, Inc., Milford, MA (US)

( * ) Notice: Subject to any disclaimer, the term of this patent is extended or adjusted under 35 U.S.C. 154(b) by 0 days.

(21) Appl. No.: 09/483,279

(22) Filed: Jan. 13, 2000

(51) Int. Cl.[7] ..... B67B 7/46
(52) U.S. Cl. ..... 30/400; 30/410; 30/423
(58) Field of Search ..... 30/400, 410, 416, 30/423

(56) References Cited

U.S. PATENT DOCUMENTS

| | | | | | |
|---|---|---|---|---|---|
| 396,555 | A | * | 1/1889 | Gilham | 30/416 |
| 597,724 | A | * | 1/1898 | Lefler | 30/447 |
| 1,267,615 | A | * | 5/1918 | Wilson | 30/448 |
| 2,540,541 | A | * | 2/1951 | Myers | 30/447 |
| 2,579,189 | A | | 12/1951 | Jenson | |
| 2,598,314 | A | * | 5/1952 | Skorupa et al. | 30/447 |
| 2,621,401 | A | * | 12/1952 | Briner | 30/447 |
| 2,636,259 | A | * | 4/1953 | Farandatos | 30/400 |
| 2,675,610 | A | * | 4/1954 | Edlund | 30/410 |
| 2,896,319 | A | | 7/1959 | Pinette | |
| 2,925,237 | A | | 2/1960 | Fox | |
| 2,979,815 | A | | 4/1961 | Rohde et al. | |
| 3,156,044 | A | | 11/1964 | Congdon et al. | |
| 3,176,063 | A | | 3/1965 | Jepson et al. | |
| 3,203,088 | A | * | 8/1965 | Voll | 30/447 |
| 3,348,305 | A | | 10/1967 | Bielak | |
| 3,433,444 | A | | 3/1969 | Smith | |
| 3,739,472 | A | * | 6/1973 | Peres | 30/6.4 |
| 3,765,085 | A | | 10/1973 | Ponczek et al. | |
| 4,028,805 | A | | 6/1977 | Figlia | |
| 4,561,182 | A | | 12/1985 | Yamamoto et al. | |
| D283,870 | S | | 5/1986 | Yamamoto et al. | |
| 4,620,476 | A | | 11/1986 | Brym | |
| 4,663,849 | A | | 5/1987 | Nickelson | |
| D296,753 | S | | 7/1988 | Tsuji et al. | |
| 4,831,735 | A | | 5/1989 | Bast et al. | |
| D302,929 | S | | 8/1989 | Thomas | |
| D304,286 | S | | 10/1989 | Schmidt | |
| 5,492,296 | A | | 2/1996 | Biber | |
| D409,063 | S | | 5/1999 | Chan | |

* cited by examiner

*Primary Examiner*—Boyer Ashley
*Assistant Examiner*—Omar Flores-Sańchez
(74) *Attorney, Agent, or Firm*—Brinks Hofer Gilson & Lione

(57) ABSTRACT

A can opening appliance is provided herein. The appliance includes a primary housing having a front surface including a can opening mechanism and a rearwardly facing locking surface. A base includes at least one upwardly extending projection for slidable engagement with the primary housing and at least one forwardly facing interlock structure for releasable engagement with the locking surface of the primary housing. A housing release button, which causes the forwardly facing interlock structure and the locking surface to enter into and out of engagement, allows the primary housing to attain a plurality of vertical positions relative to the base.

19 Claims, 10 Drawing Sheets

28
30

122
120
112
114
8
116
B
B
110
6
112
118

108
104
6
106
100
98

ADJUSTABLE-HEIGHT CAN OPENING APPLIANCE

FIELD OF THE INVENTION

This invention relates generally to an electric can opener appliance, and more specifically to an electric can opener that can be adjusted to a variety of heights in order to open cans of varying sizes.

BACKGROUND OF THE INVENTION

The domestic electric can opener is a popular and widely accepted kitchen appliance. Effective openers should able to open a variety of can sizes found in the home. This has resulted in many manufacturers constructing very large can openers in order to accommodate tall, large cans such as juice or coffee cans. These openers tend to require a large amount of space and yet are only occasionally required to open large cans.

This situation has also prompted manufacturers to construct hand-held electric can openers. These openers, however, have the disadvantage of requiring the user to simultaneously hold and guide the can opener and hold the can in a stationary position. To eliminate this problem, another approach has been to make the can opener under-cabinet or wall-mounted so that it can be placed at any desired height above a counter top surface. However, wall-mounted can openers may interfere with the user's work-space in the kitchen and cannot be easily moved out of the way.

An example of an electric can opener that can be adjusted in height is disclosed in a patent to Bast et al. U.S. Pat. No. 4,831,735. The Bast et al. patent discloses an electric can opener that is supported by a counter top or other surface and is adjustable telescopically via a manually operated knob. However, this opener achieves only two extreme positions, a lower and a raised position.

BRIEF SUMMARY OF THE INVENTION

To alleviate the disadvantages of the prior art, a can opening appliance is provided herein. The appliance includes a primary housing having a front surface including a can opening mechanism and a rearwardly facing locking surface. A base includes at least one upwardly extending projection for slidable engagement with the primary housing and at least one forwardly facing interlock structure for releasable engagement with the locking surface of the primary housing. A housing release button, which causes the forwardly facing interlock structure and the locking surface to enter into and out of engagement, allows the primary housing to attain a plurality of vertical positions relative to the base.

In another aspect of the invention, the primary housing includes a forwardly facing locking surface. The base includes at least one rearwardly facing interlock structure for releasable engagement with the locking surface of the primary housing. The release button causes the rearwardly facing interlock structure and the locking surface to enter into and out of engagement, allowing the primary housing to attain a plurality of vertical positions relative to the base.

In another aspect of the invention, the appliance includes a primary housing having a front surface including a can opening mechanism and a rearwardly facing surface including a plurality of aligned indentations. A base has an upwardly extending enclosure for slidable engagement with the primary housing and two forwardly facing interlock structures for releasable engagement with the indentations of the primary housing. A housing release button causes the forwardly facing structures and the indentations to enter into and out of engagement, allowing the primary housing to attain a plurality of vertical positions relative to the base.

In another aspect of the invention, the appliance includes a primary housing having a can opening mechanism. A stationary base has at least one upwardly extending projection for slidable engagement with the primary housing. A locking surface is located on either the primary housing or the base, and at least one corresponding interlock structure is located on the other of the primary housing or the base for releasable engagement with the locking surface. A housing release button causes the interlock structure to enter into and out of engagement with the locking surface, allowing the primary housing to attain a plurality of vertical positions relative to the base.

In another aspect of the invention, the appliance includes a stationary base and a primary housing having a can opener mechanism. The primary housing is mounted for vertical movement relative to the base. An integral flexible latch mechanism is located on either the base or the housing, and a latch-receiving structure is located on the other of the base or the housing. A latch-release actuator is in communication with and moves the latch mechanism for disengagement from the latch-receiving structure to allow vertical movement of the housing to a plurality of latching positions relative to the base.

The invention may also be embodied in a method of opening cans. The method includes the steps of providing a can opener having a locking housing release button and a can opening mechanism. A user operates the can opener to remove the lid from a first can. The user then depresses the release button and adjusts the can opener housing to raise or lower the height of the can opening mechanism. The release button is then released to lock the housing into this new position. The can opener is then operated to remove the lid from a second can having a height different than the first can.

The invention provides a can opener appliance that can be raised or lowered to achieve a plurality of height positions. This allows the user to raise or lower the can opening mechanism in order to more easily open cans of varying sizes. In the present configuration, the invented can opening appliance allows larger cans to rest on the same surface on which the appliance itself is resting, thereby lending more stability to the appliance and the can during the opening operation.

The foregoing and other features and advantages of the invention will become further apparent from the following detailed description of the presently preferred embodiments, read in conjunction with the accompanying drawings.

BRIEF DESCRIPTIONS OF SEVERAL VIEWS OF THE DRAWINGS

DETAILED DESCRIPTION OF THE INVENTION

Figure 1:
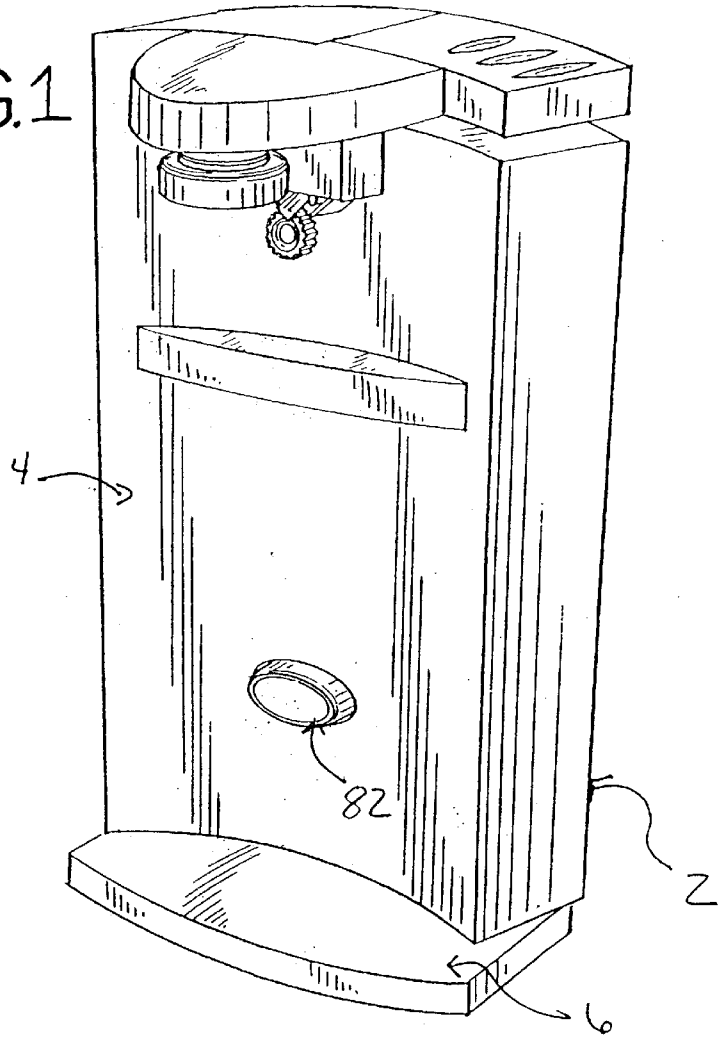
FIG. 1 is a perspective view of the preferred embodiment of the present invention in a lowered position.
Figure 2:
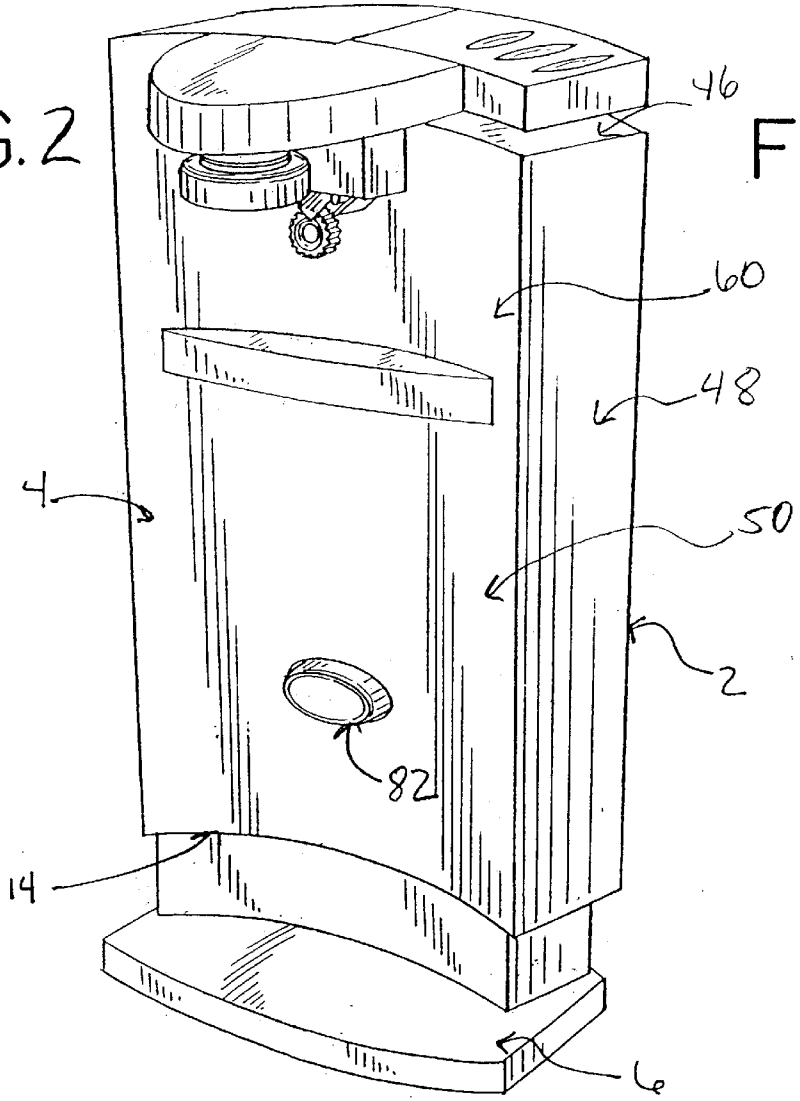
FIG. 2 is a perspective view of the preferred embodiment of FIG. 1 in a raised position.
Figure 3:
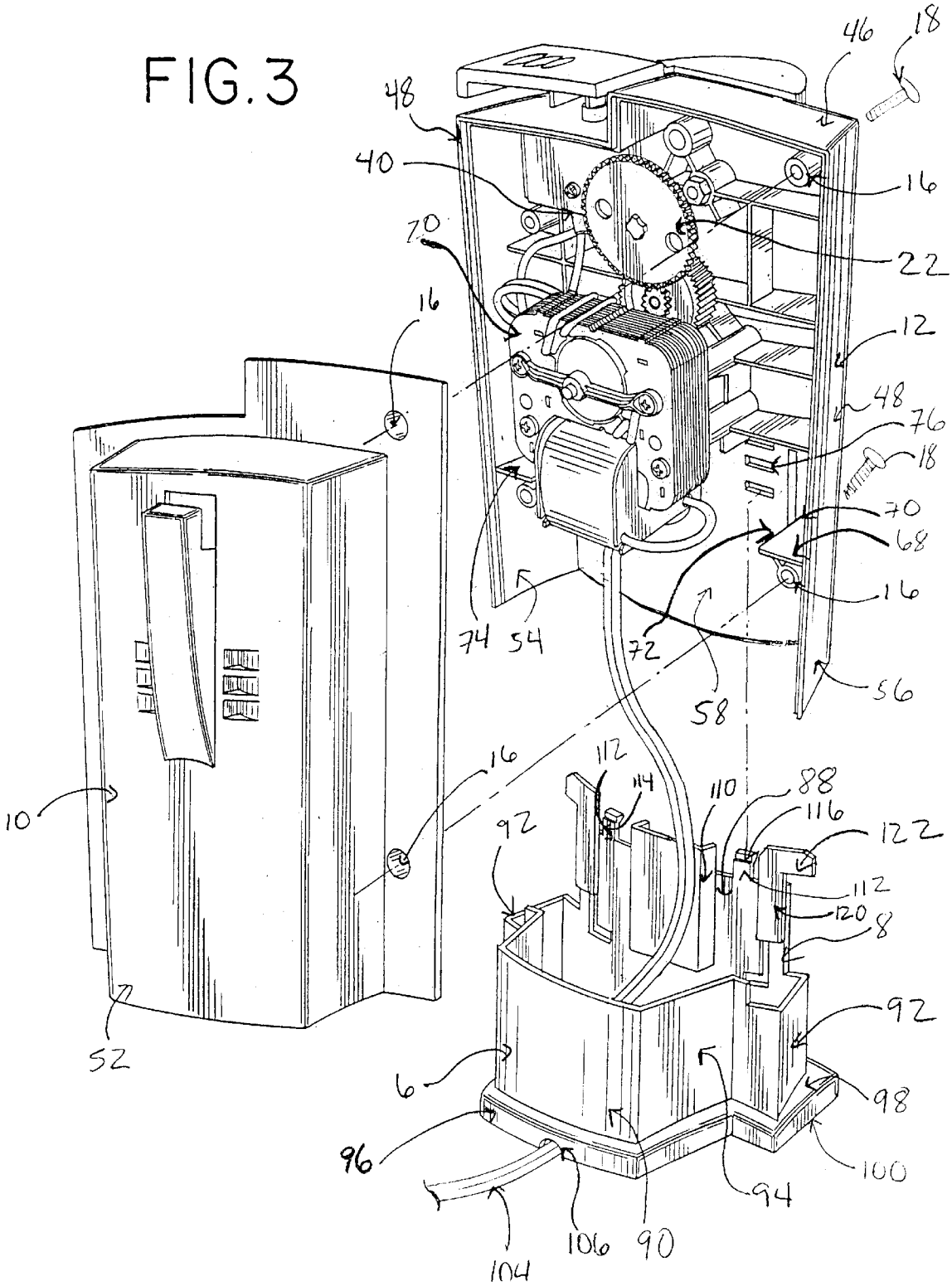
FIG. 3 is an exploded, rear perspective view of the preferred embodiment of FIG. 1.
Figure 4:
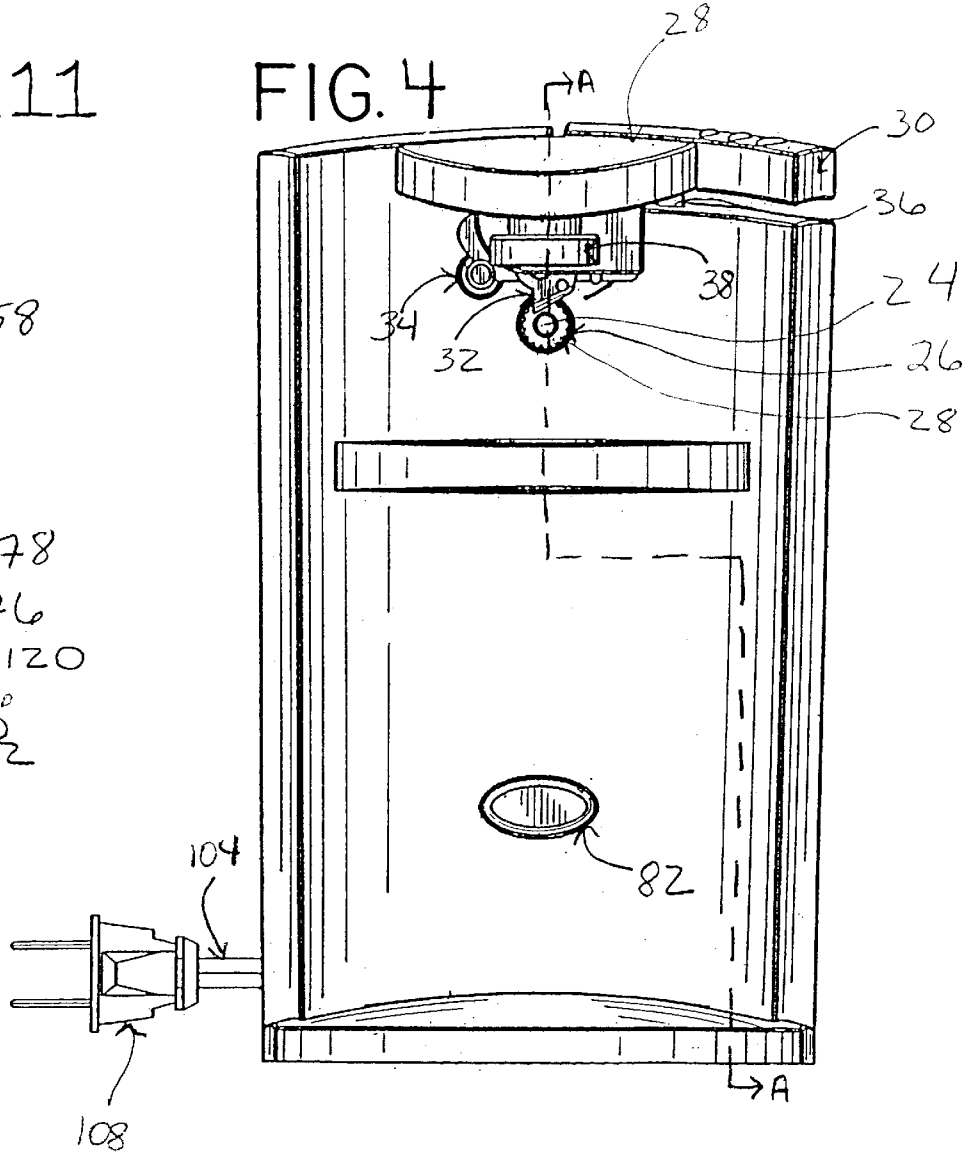
FIG. 4 is a front plan view of the preferred embodiment of FIG. 1.
Figures 5, 9, 10:
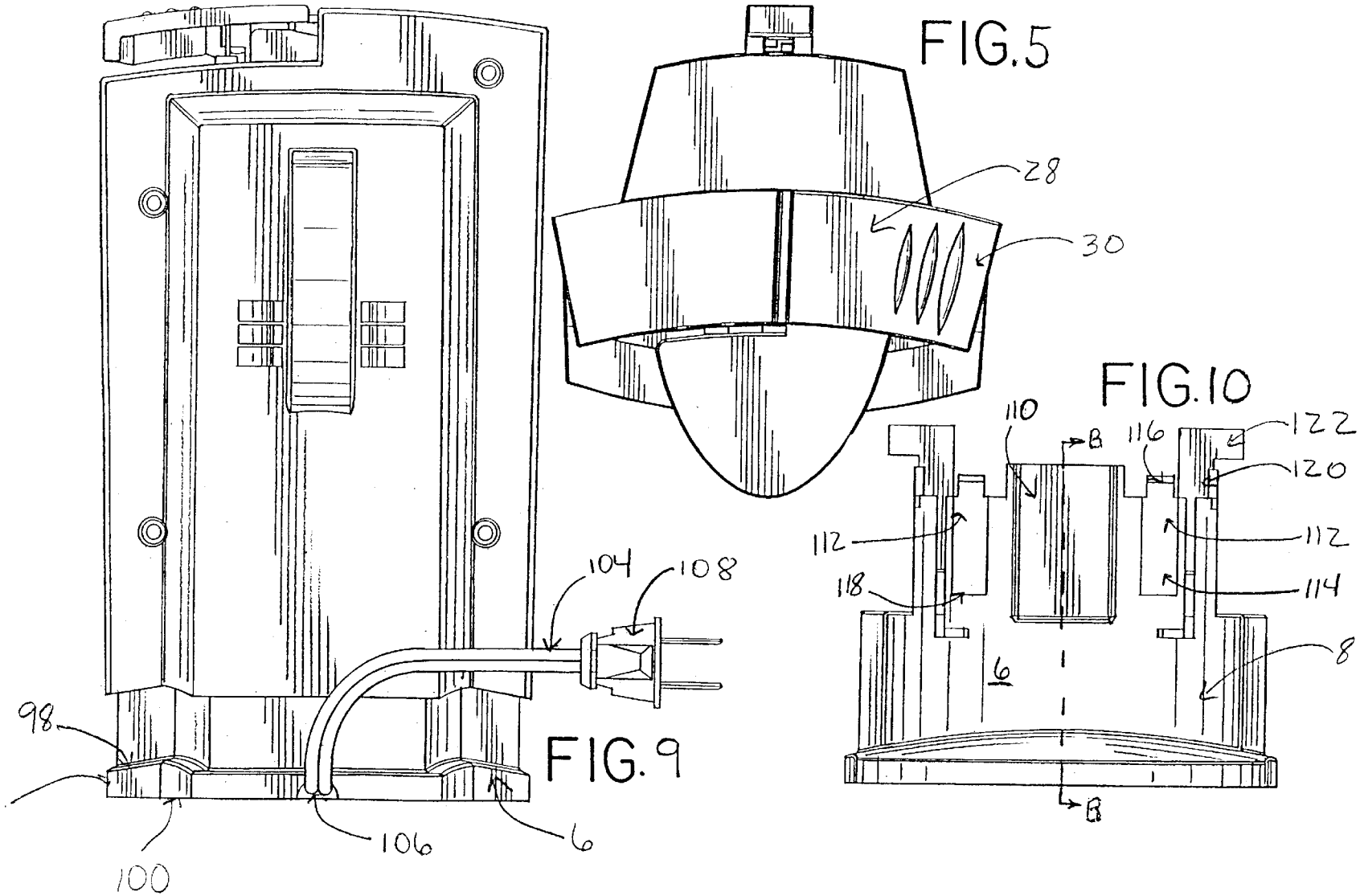
FIG. 5 is a top plan view of the preferred embodiment of FIG. 1.
FIG. 9 is a rear plan view of the preferred embodiment of FIG. 1 that shows the can opener in the raised position.
FIG. 10 is a front plan view of the base.

Referring to FIGS. 1 and 2, the can opener 2 includes a primary housing 4 and a base 6 with an upper end portion 8 (FIG. 3). The primary housing 4 preferably has a rear portion 10 and a front portion 12, together defining a downwardly facing open area 14. In the preferred embodiment, the front portion 12 and rear portion 10 are held together through connections 16 located on the rear portion 10 and front portion 12. The connections 16 are preferably held together by screws 18. As shown in FIGS. 3 and 4, a motor 20 and a gear assembly 22 are contained within the primary housing 4. The gear assembly 22 includes an output shaft 24 that drives a feedwheel 26. The feedwheel 26 includes serrations 28 defined around an annular portion of the feedwheel 26. As shown in FIGS. 4 and 5, a can opening mechanism 28 is associated with the primary housing 4 and preferably includes a pivotally-mounted lever 30, a cutter 32, a can guide 34, a switch actuator 36, and a lid-holding magnet 38.

The can opening mechanism 28 is preferably conventional. To open a can, the lever 30 is pivoted upwardly, which in turn raises the cutter 32. The can is then placed vertically against the can opener 2 so that the upper lip of the can lid is underlying the serrations 28 of the feedwheel 26. The lever 30 is then pivoted downwardly to cause the cutter 32 to puncture the can lid and cause the switch actuator 36 to actuate a switch 40. The switch 40 in turn energizes the motor 20 that drives the gear assembly 22 and output shaft 24, thereby allowing the feedwheel 26 to rotate the can in engagement with the cutter 32. The can guide 34 maintains the positioning of the can relative to the cutter 32. The cutter 32 severs the lid completely from the can after complete rotation of the can. The magnet 38 preferably retains the severed lid to prevent it from falling into the can.

Figure 15:
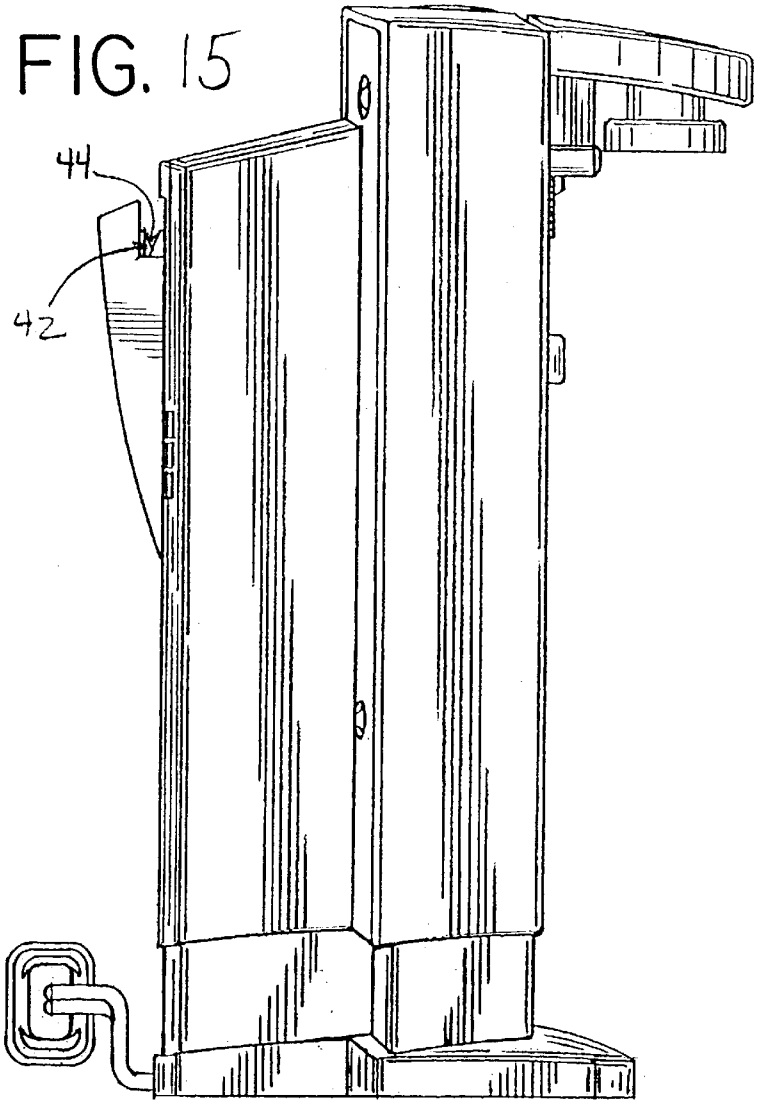
FIG. 15 is a left side view of the preferred embodiment of FIG. 1.
Figure 6:
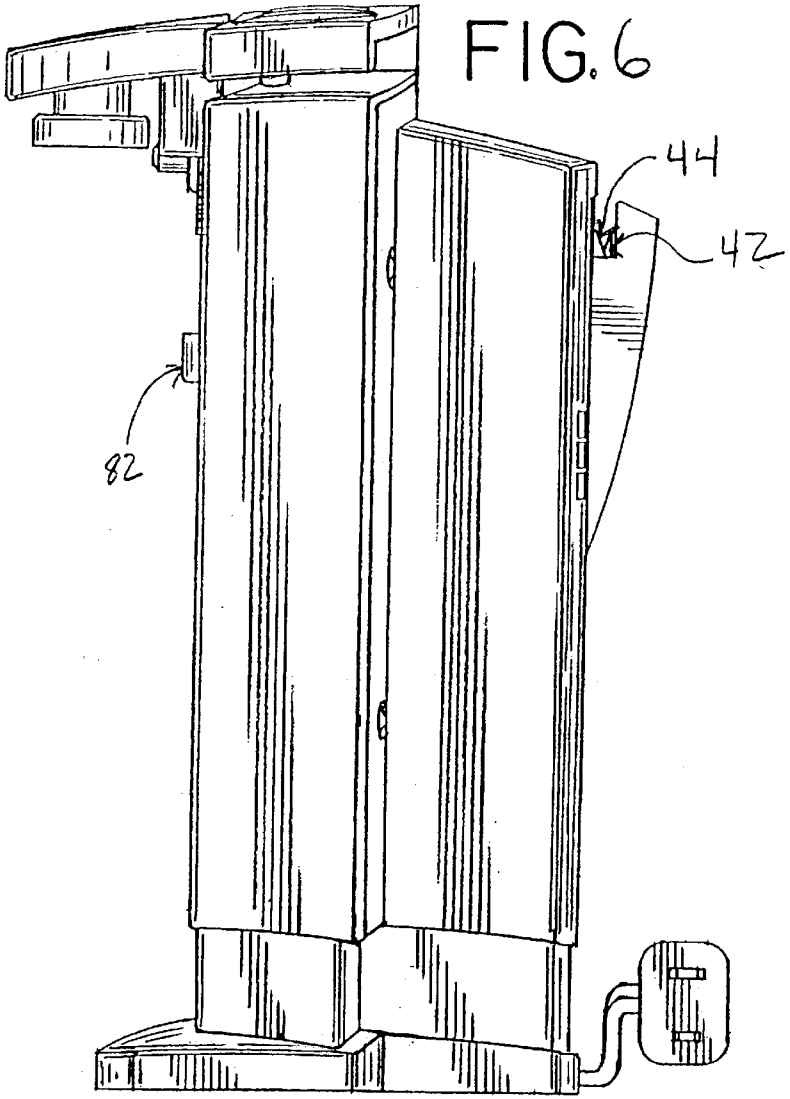
FIG. 6 is a right side view of the preferred embodiment of FIG. 1 in the raised position.

As shown in FIGS. 6 and 15, a conventional knife sharpener 42 may be incorporated into the primary housing 4. The sharpener 42 contains a slot 44 so that a knife can be passed through the sharpener 42 in order to sharpen the blade of the knife.

Figure 7:
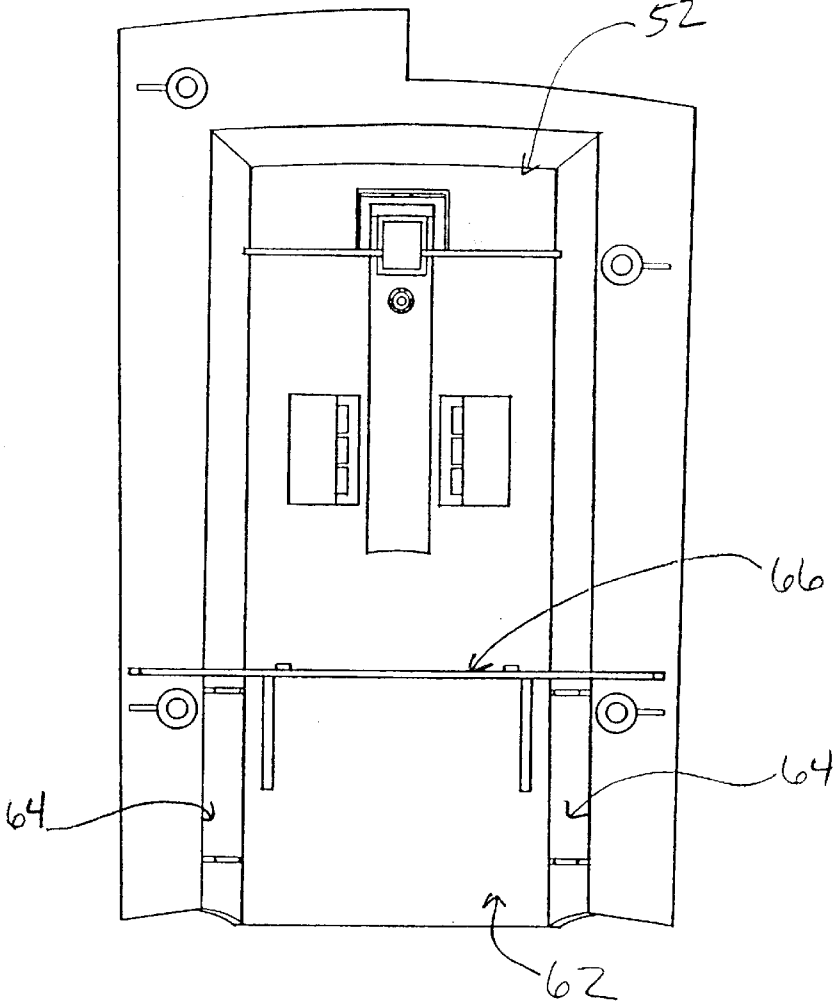
FIG. 7 is a front plan view of the primary housing with the components and front portion removed.

As shown in FIGS. 2 and 3, a top wall 46, side walls 48, a front wall 50, and a rear wall 52 preferably define the portions 12 and 10, respectively, of the primary housing 4. An inner side wall 54 and an outer side wall 56 define each side wall 48, and an interior surface 58 and a front surface 60 define the front wall 50. As shown in FIG. 7, the rear wall 52 includes an inner rear wall 62 and inner rear side walls 64. Also preferably associated with the primary housing 4 is a plate 66. Preferably, the plate 66 abuts the inner rear wall 62 and inner rear side walls 64 and provides structural stability to the front portion 12.

Figure 8:
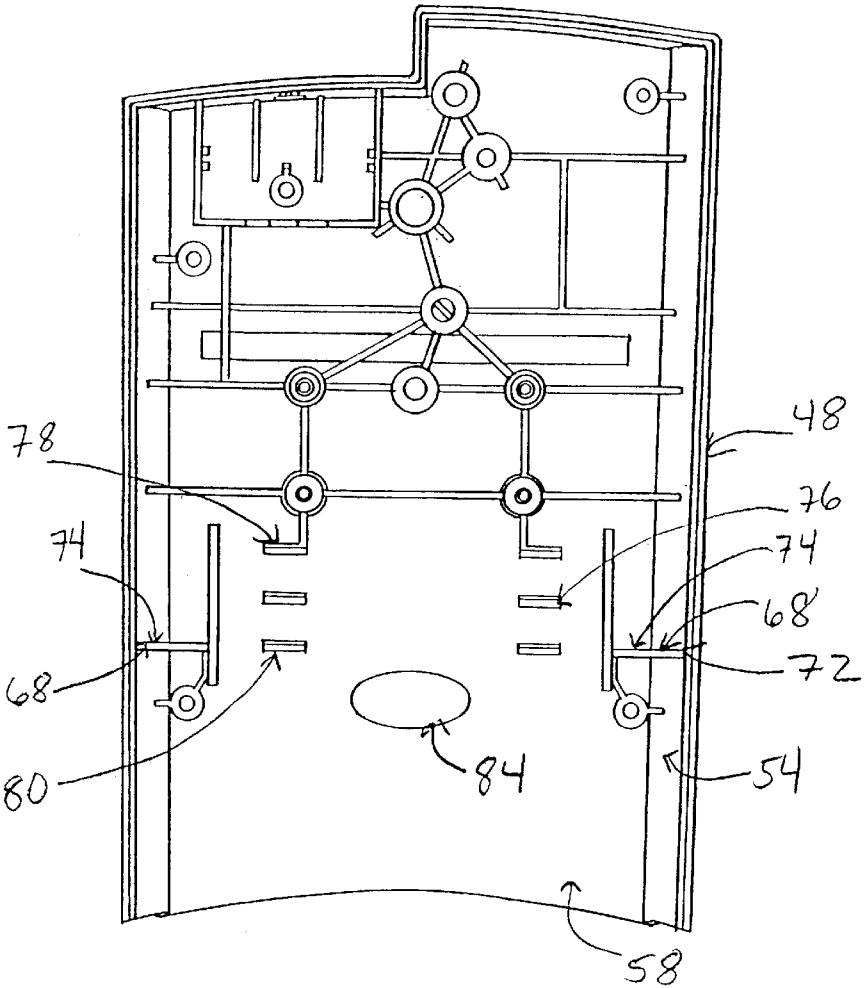
FIG. 8 is a rear plan view of the primary housing, with the components and rear portion removed.

Referring now to FIGS. 3 and 8, a pair of coplanar shelves 68 preferably are associated within the primary housing 4. Each shelf 68 includes a forward edge 70, an outer side edge 72, and a top 74, which preferably faces upwardly. The outer side edge 72 of each shelf 68 preferably abuts the inner side wall 54 of each side wall 48 and the forward edge 70 of is each shelf 68 abuts the interior surface 58.

Interlocks 76 are also preferably located on the interior surface 58. There are preferably six interlocks 76 forming two columns of three interlocks each, including an uppermost interlock 78 and a lowermost interlock 80. A release button 82 is preferably associated with the front wall 50. The release button 82 is preferably a button-shaped insert protruding from a throughgoing opening 84 in the interior surface 58 and front surface 60.

The base 6 preferably includes a front member 88, a rear member 90, and side members 92 which preferably form an upstanding enclosure 94. The base 6 also has a bottom member 96 having a width sufficient to impart standing stability to the can opener 2. A top surface 98 and a bottom surface 100 define the bottom member 96. An opening 102 (not shown) is preferably defined within the bottom member 96. The opening 102 allows an electrical cord 104 to be slidably passed from the primary housing 4 and through the opening 102. After passing through the opening 102, the electrical cord 104 passes through a hole 106 in order for a plug 108 on the end of the electrical cord 104 to be inserted into an electrical outlet (FIG. 9). The hole 106, which is not part of the present invention, prevents the can opener 2 from resting on the electrical cord 104.

The primary housing 4 can be raised or lowered with respect to the base 6. The enclosure 94 and the primary housing 4 are preferably formed in a complimentary cross-section so that the primary housing 4 slidably engages the enclosure 94 of the base 6. In the preferred embodiment, the enclosure 94 is snugly nested within the downwardly facing space 14 of the primary housing 4 when the primary housing 4 is in the lower-most position. Because of the nesting relationship between the primary housing 4 and the enclosure 94, the primary housing 4 moves telescopically in a substantially vertical direction relative to the base 6 in a stable manner when the primary housing 4 is being raised or lowered.

Referring now to FIG. 10, a flex-plate 110 and upwardly facing flexible latching fingers 112 preferably extend from the front member 88 of the base 6 and are preferably molded from a polymeric material integrally with the base 6. In the preferred embodiment there are two fingers 112 located on opposite sides of the flex-plate 110. The fingers 112 are pivotally bendable along with the front member 88 and are defined by main bodies 114 and free ends 116. The main bodies 114 are substantially vertical, and an end 118 of each main body 114 is fixed to the front member 88. As shown in FIG. 3, the free ends 116 of the fingers 112 protrude forwardly from the main bodies 114.

In other embodiments of the invention, the fingers 112 can be attached to the enclosure 94 in a different location depending on the configuration of the housing 4. Additionally, a different number of fingers 112 can be used.

Figure 11:
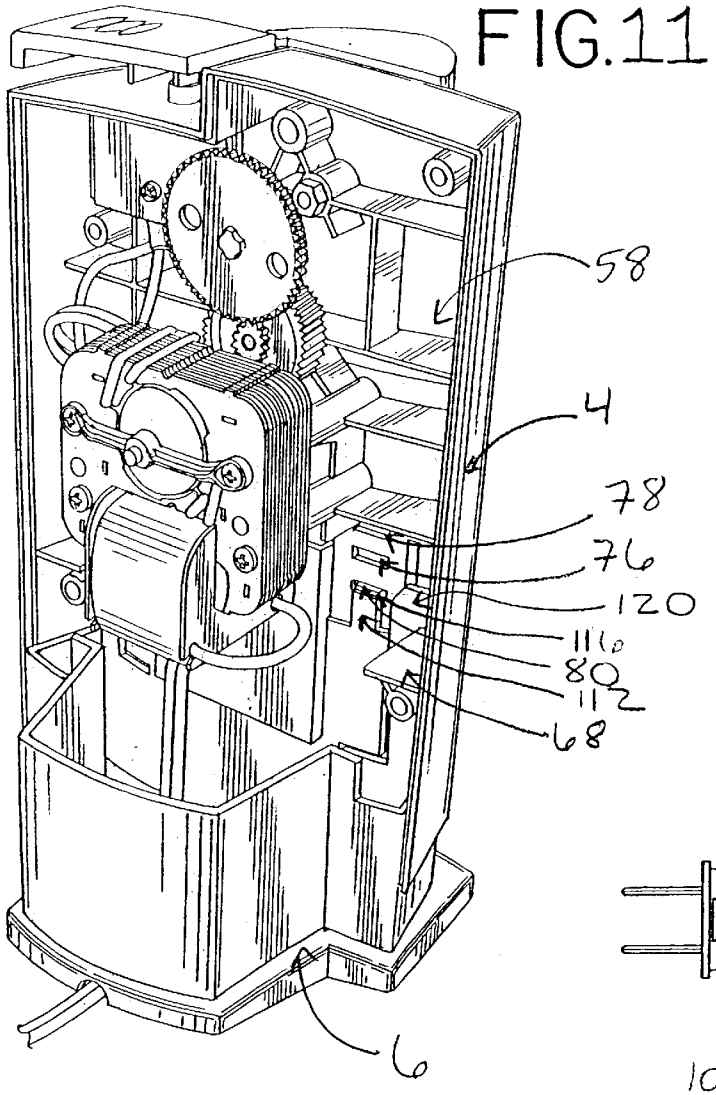
FIG. 11 is a rear, perspective view of the preferred embodiment of FIG. 1 with the rear portion of the primary housing removed, and shows the can opener in the raised position.

As shown in FIG. 11, the free ends 116 of the fingers 112 interface with the interlocks 76 so that the primary housing 4 remains in a raised or lowered position with respect to the base 6 when the fingers 112 are engaged with the interlocks 76, which form a receiving structure for the fingers 112. In the preferred embodiment, the interlocks 76 are made up of indentations and the free ends 116 are defined by corresponding protrusions. However, other frictional and latching engagement configurations are possible. For example, abrasive patches that allow for frictional engagement can define the interlocks 76 and free ends 116. In the alternative, the interlocks 76 may comprise protrusions extending rearwardly from the interior surface 58 for engagement with the fingers 112.

Preferably, two upwardly oriented stops 120 are attached on opposite ends of the front member 88. Free portions 122 are associated with the stops 120. In the preferred embodiment, each free portion 122 forms a substantial right angle relative to the rest of the stop 120. The free portions 122 preferably oppose each other. In the preferred embodiment, the stops 120 are co-planar with the flex-plate 110 and the main bodies 114 of the fingers 112.

Figure 12:
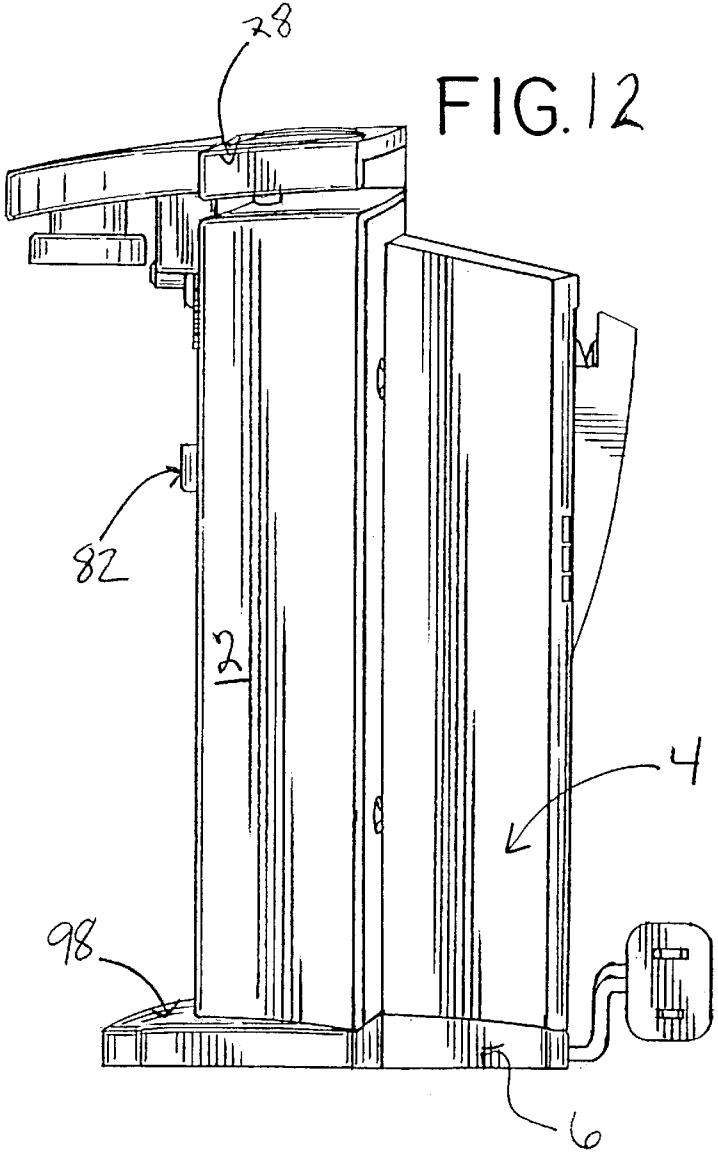
FIG. 12 is a right side view of the preferred embodiment of FIG. 1.

The operation of the height-adjusting feature of the can opener 2 is described below. As shown in FIG. 12, the primary housing 4 is adjacent to the top surface 98 when the can opener 2 is in the lowermost position. The free ends 116 of the fingers 112 are engaged with the uppermost interlocks 78 on the interior surface 58. The stops 120 are positioned above the shelves 68 so that the stops 120 do not contact the shelves 68. The front member 88 of the base 6 is vertical and in a resting position.

Figure 13:
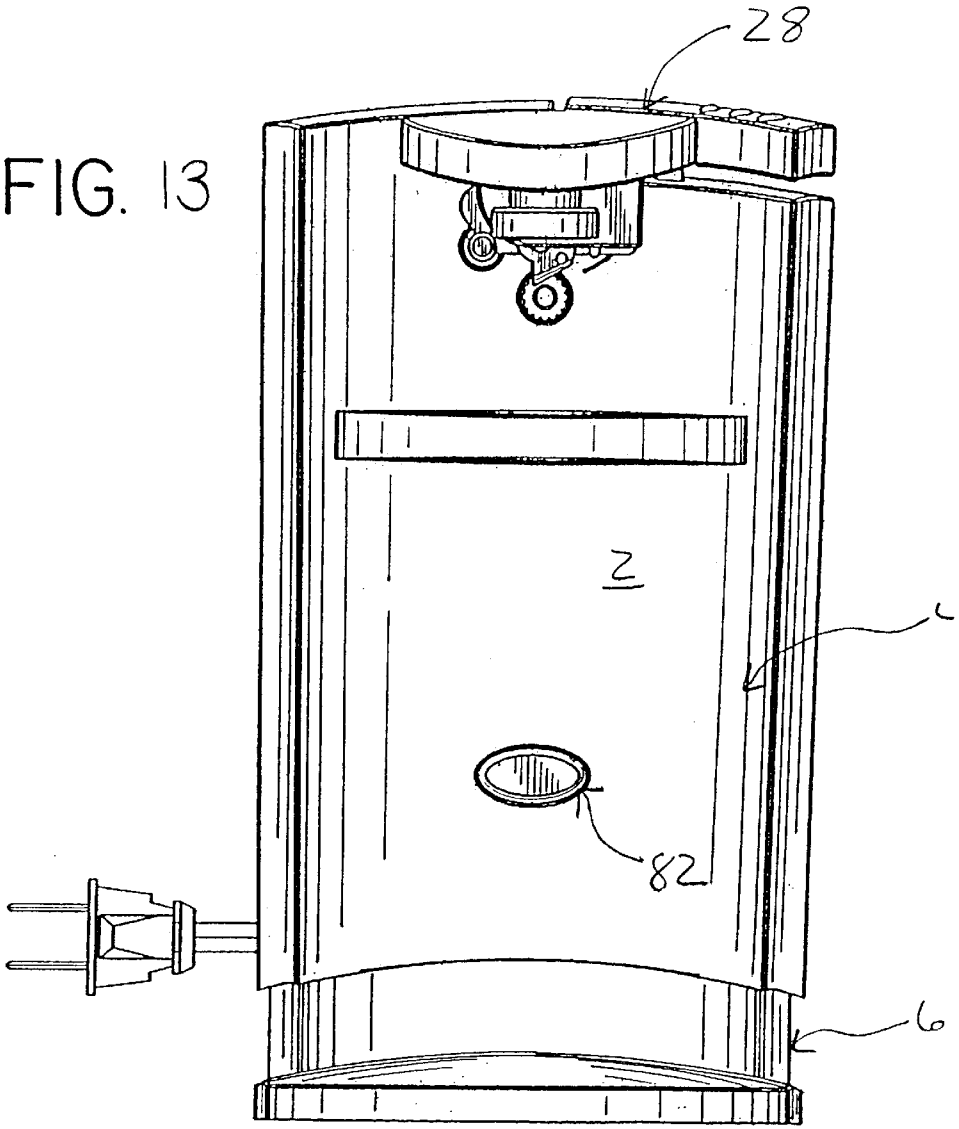
FIG. 13 is a front plan view of the preferred embodiment of FIG. 1 in the raised position.
Figure 14:
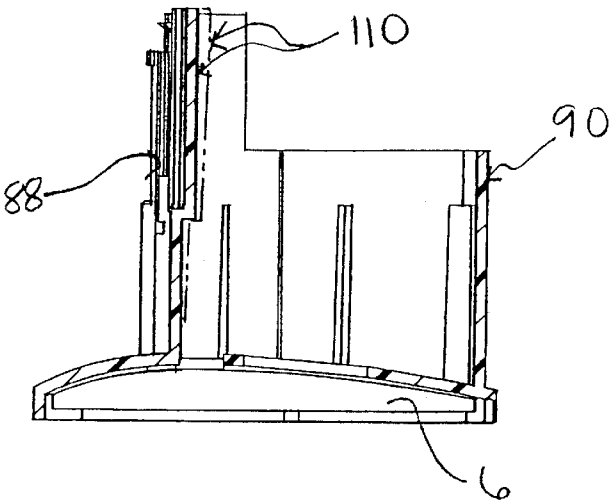
FIG. 14 is a sectional view of the base taken along line B—B of FIG. 10 and shows the base in resting and deflected positions.
Figure 17:
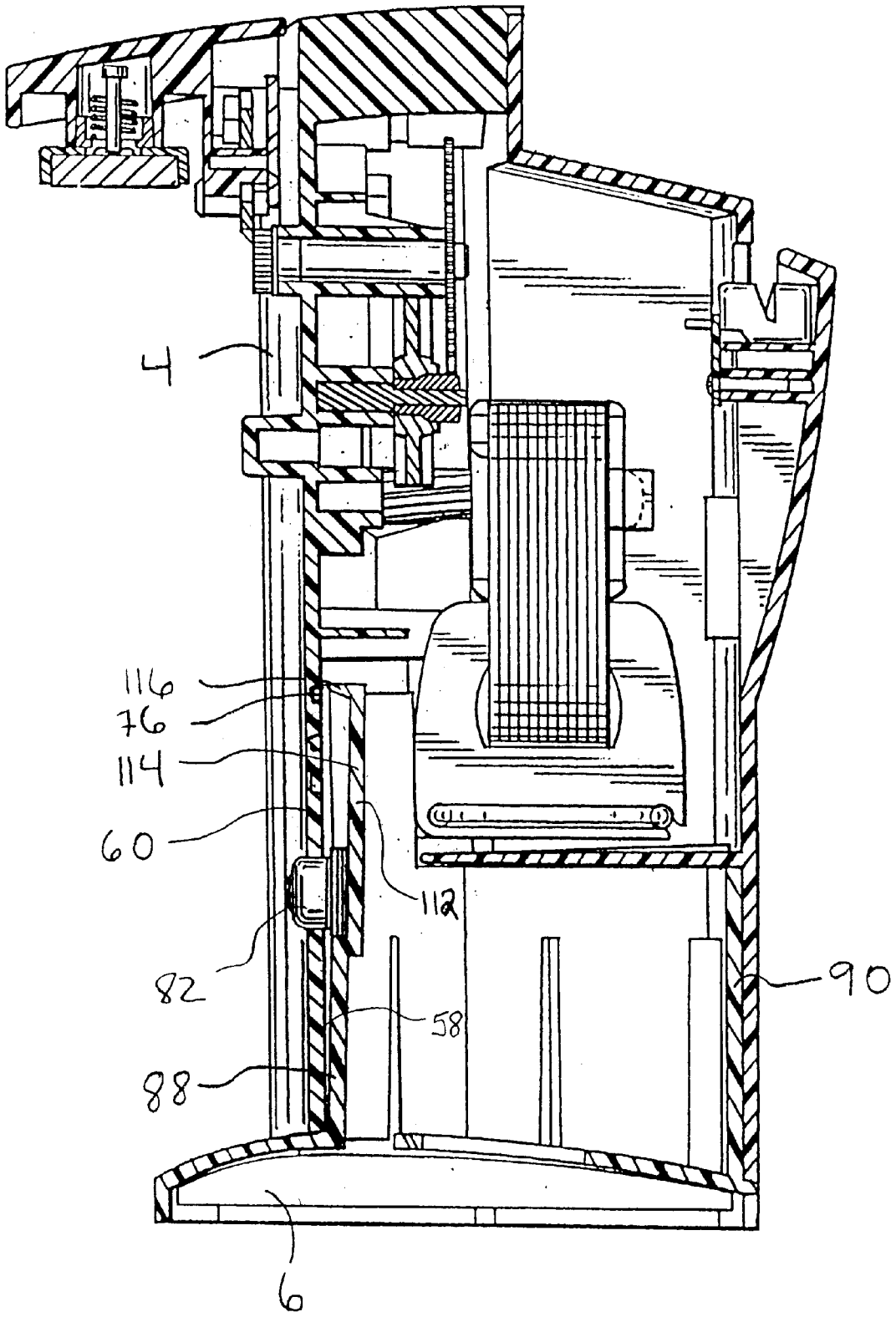
FIG. 17 is a sectional side view of the preferred embodiment taken along line A—A of FIG. 4 and shows the can opener in the actuated position.

As illustrated in FIG. 13, to raise the can opener 2, the release button 82 may be actuated to release the latching action of the fingers 112 and the interlocks 76. In particular, the release button 82 is first depressed so that it comes into contact with and depresses the flex-plate 110 inwardly (FIGS. 14 & 17). The front member 88 of the base 6 will pivotally deflect towards the rear member 90 of the base 6. The free ends 116 of the fingers 112 will move inwardly along with the front member 88, and will no longer be engaged with the interlocks 76 (not shown). The primary housing 4 can then be moved in an upwardly vertical direction relative to the base 6 until the desired height for the can opener 2 is achieved (FIGS. 2, 6, 11, and 13). The release button 82 is then released so that the front member 88 of the base 6 will return to its resting position. The primary housing 4 can then be manipulated so that the free ends 116 of the fingers 112 enter into engagement with the interlock 76 corresponding to the desired height. Upon engagement, the primary housing 4 will remain in this height-adjusted position. The can opening mechanism 28 previously described (FIGS. 4 and 5) can then open the can. The can opener 2 can be further raised or lowered utilizing the method just described to accommodate a can of a different size.

The stops 120 are utilized to prevent the primary housing 4 from being raised past the upper-most position and separating from the base 6. When the lowermost interlocks 80 become substantially co-planar with the free ends 116 of the fingers 112, the highest position the can opener 2 can attain has been achieved. When the free ends 116 enter engagement with the lowermost interlocks 80, the free portions 122 of the stops 120 come into contact with the top 74 of the shelves 68, preventing the primary housing 4 from rising any further.

Figure 16:
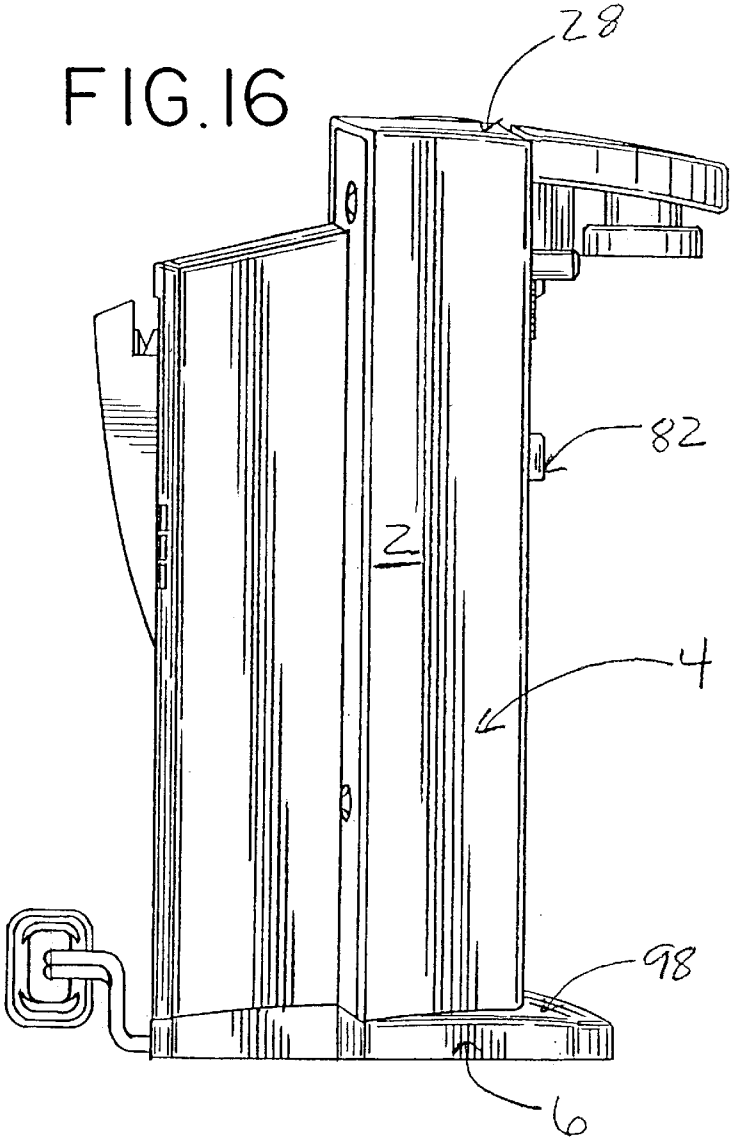
FIG. 16 is a left side view of the preferred embodiment of FIG. 1 in the raised position.
Figure 18:
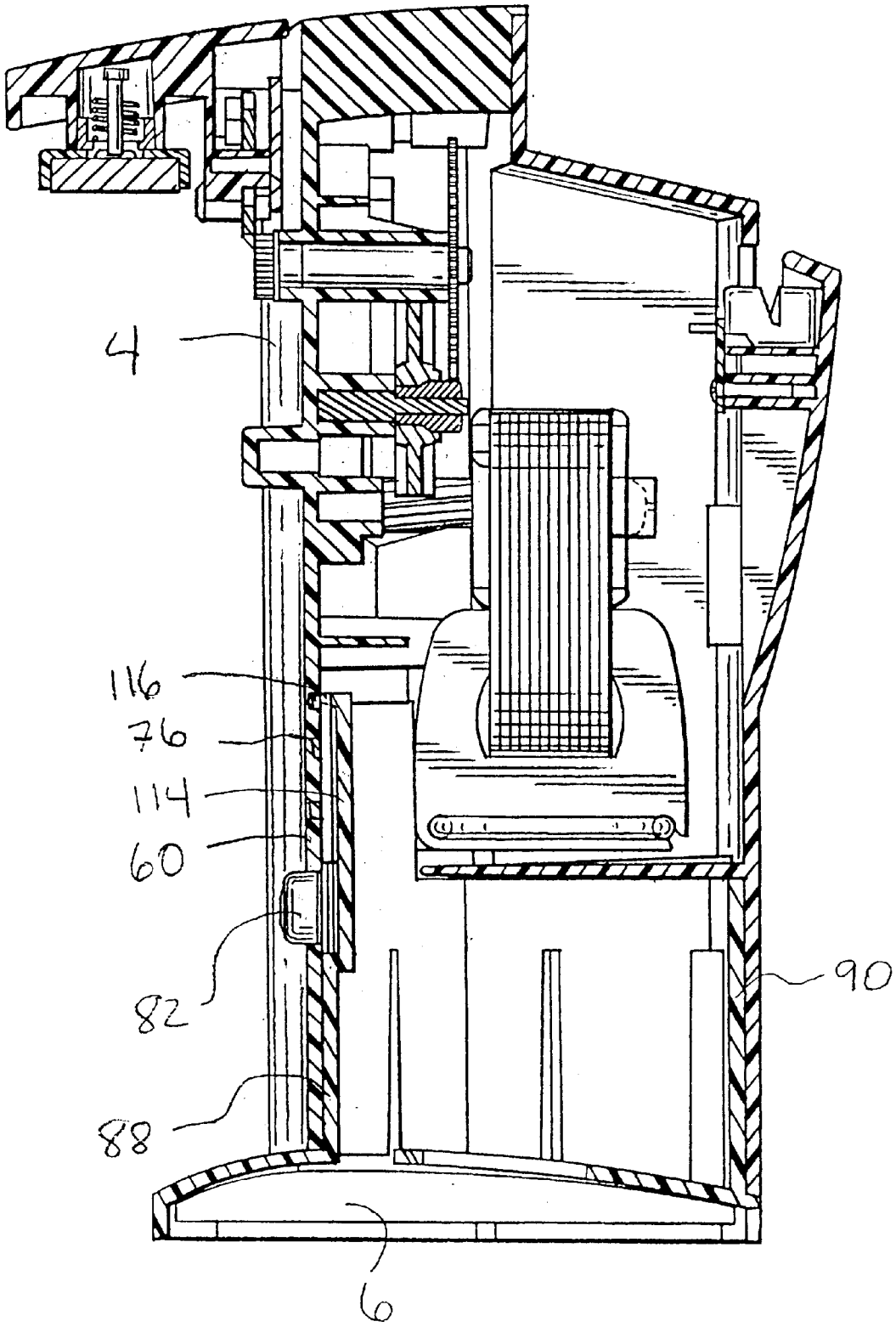
FIG. 18 is a sectional side view of the preferred embodiment taken along line A—A of FIG. 4 and shows the can opener in the fully engaged position.

To lower the can opener 2 the steps are substantially the same as when the can opener 2 is being raised. The release button 82 is depressed so that it comes into contact with and depresses the flex-plate 110 inwardly. The front member 88 of the base 6 will deflect towards the rear member 90. The free ends 116 of the fingers 112 will pivot accordingly and will no longer be engaged with the interlocks 76 (not shown). The primary housing 4 can then be moved in a downwardly, vertical direction until the desired height for the can opener 2 is achieved (FIGS. 1, 4, and 12). The release button 82 is then released so that the front member 88 will return to its resting position (FIG. 18). The primary housing 4 can be manipulated so that the free ends 116 of the fingers 112 enter into engagement with the interlocks 76 corresponding to the desired height. As shown in FIG. 16, if the lower-most position is desired, the primary housing 4 can be moved in a downwardly vertical direction until it comes into contact with the top surface 98 before releasing the release button 82. The can opening mechanism 28 previously described can then open the can.

While the embodiments of the invention disclosed herein are presently considered to be preferred, various changes and modifications can be made without departing from the spirit and scope of the invention. For example, the interior surface 58 of the primary housing 4 can include a different number of interlocks 76, and configurations other than two columns of interlocks 76 are also possible. Additionally, the interlocks 76 themselves can also be located on a surface other than the interior surface 58 such as the inner rear wall 62. The scope of the invention is indicated in the appended claims, and all changes that come within the meaning and range of equivalents are intended to be embraced therein.

What is claimed is:

1. A can opener comprising:

a primary housing having a front surface including a can opening mechanism and a rearwardly facing locking surface, wherein said primary housing further comprises a rear portion and a front portion, said portions defining a downwardly facing interior space;

a base having at least one upwardly extending projection for slidable engagement with said primary housing and at least one forwardly facing interlock structure for releasable engagement with a plurality of indentations on said locking surface of said primary housing, wherein at least one upwardly extending projection further comprises an enclosure adapted to fit telescopically within said lower interior space of said primary housing;

wherein said plurality of indentations on said locking surface further comprises a plurality of slots adapted to receive said at least one forwardly facing interlock structure of said base;

a housing release button;

whereby said housing release button causes said forwardly facing interlock structure and plurality of indentations on said locking surface to enter into and out of engagement to allow said primary housing to attain a plurality of vertical positions relative to said base.

2. The can opener of claim 1 wherein said primary housing further comprises at least one stop which engages a corresponding stop on said enclosure to prevent said primary housing and said base from separating.

3. A can opener comprising:

a primary housing having a front surface including a can opening mechanism and a forwardly facing locking surface, wherein said primary housing further comprises a rear portion and a front portion, said portions defining a downwardly facing interior space;

a base having at least one upwardly extending projection for slidable engagement with said primary housing and at least one rearwardly facing interlock structure for releasable engagement with a plurality of indentations on said locking surface of said primary housing, wherein at least one upwardly extending projection further comprises an enclosure adapted to fit telescopically within said lower interior space of said primary housing;

wherein said plurality of indentations on said locking surface further comprises a plurality of slots adapted to receive said at least one rearwardly facing interlock structure of said base; and a housing release button;

whereby said housing release button causes said rearwardly facing interlock structure and said locking surface to enter into and out of engagement to allow said primary housing to attain a plurality of vertical positions relative to said base.

4. The can opener of claim 3 wherein said primary housing further comprises at least one stop which engages with a corresponding stop on said enclosure to prevent said primary housing and said base from separating.

5. A can opener comprising:

a primary housing having a front surface including a can opening mechanism and a rearwardly facing surface including a plurality of aligned indentations;

a base having an upwardly extending enclosure for slidable engagement with said primary housing and two forwardly facing interlock structures for releasable engagement with said indentations of said primary housing;

a housing release button;

whereby said housing release button causes said forwardly facing interlock structures and said indentations to enter into and out of engagement to allow said primary housing to attain a plurality of vertical positions relative to said base.

6. The can opener of claim 5 wherein said primary housing further comprises a rear portion and a front portion, said portions defining a downwardly facing interior space.

7. The can opener of claim 6 wherein said enclosure is adapted to fit telescopically within said lower interior space of said primary housing.

8. The can opener of claim 7 wherein said indentations are configured in rows of two.

9. The can opener of claim 8 wherein said primary housing further comprises two stops which engage with corresponding stops on said enclosure to prevent said primary housing and said base from separating.

10. A can opener comprising:

a primary housing having a can opening mechanism;

a stationary base having at least one upwardly extending projection for slidable engagement with said primary housing;

a locking surface located on one of said primary housing and said base;

at least one corresponding interlock structure located on the other of said primary housing and said base for releasable engagement with a plurality of indentations on said locking surface, wherein at least one upwardly extending projection further comprises an enclosure adapted to fit telescopically within a lower interior space of said primary housing;

wherein said plurality of indentations on said locking surface further comprises a plurality of slots adapted to receive said at least one interlock structure;

a housing release button;

whereby said housing release button causes said interlock structure to enter into and out of engagement with said locking surface to allow said primary housing to attain a plurality of vertical positions relative to said base.

11. The can opener of claim 10 wherein said base includes said interlock structure and said primary housing includes said locking surface.

12. The can opener of claim 10 wherein said base includes said locking surface and said primary housing includes said interlock structure.

13. A can opener comprising:

a stationary base; and a housing having a can opening mechanism, said housing mounted for vertical movement relative to said base;

wherein one of said base and said housing includes an integral flexible latch mechanism and the other of said base and said housing includes a latch-receiving structure to allow vertical movement of said housing to a plurality of latching positions relative to said base;

wherein said flexible latch mechanism comprises a plurality of projecting portions;

wherein said base includes said flexible latch mechanism and said housing includes said latch-receiving structure;

wherein said flexible latch mechanism is integrally molded with said base of a polymeric material;

wherein said latch-receiving structure further comprises a series of indentations adapted to receive a projecting portion of said flexible latch mechanism;

wherein said plurality of projecting portions of said flexible latch mechanism includes a pair of flexible fingers.

14. The can opener of claim 13 wherein said latch-release actuator further comprises an upstanding button having a projecting portion extending through said housing and a base portion movably linked to said fingers.

15. A can opener, comprising:

a stationary base; and a housing having a can opening mechanism, said housing mounted for vertical movement relative to said base;

wherein one of said base and said housing includes an integral flexible latch mechanism and the other of said base and said housing includes a latch-receiving structure to allow vertical movement of said housing to a plurality of latching positions relative to said base;

wherein said flexible latch mechanism comprises a plurality of projecting portions;

wherein said housing includes said flexible latch mechanism and said base includes said latch-receiving structure.

16. The can opener of claim 15 wherein said flexible latch mechanism is integrally molded of a polymeric material with said housing.

17. The can opener of claim 16 wherein said latch-receiving structure further comprises a series of indentations adapted to receive a projecting portion of said flexible latch mechanism.

18. The can opener of claim 17 wherein said plurality of projecting portions of said flexible latch mechanism includes a pair of flexible fingers.

19. The can opener of claim 18 wherein said latch-release actuator further comprises an upstanding button having a projecting portion extending through said housing and a base portion movably linked to said fingers.

* * * * *